United States Patent [19]

Lew

[11] 4,125,257

[45] Nov. 14, 1978

[54] EXERCISING DEVICE FOR AERIAL EXERCISES

[76] Inventor: Hyok Sang Lew, 1620 E. Blacklidge, #6, Tucson, Ariz. 85719

[21] Appl. No.: 481,856

[22] Filed: Jun. 24, 1974

Related U.S. Application Data

[63] Continuation-in-part of Ser. No. 379,413, Jul. 16, 1973, Pat. No. 4,052,070.

[51] Int. Cl.[2] ..... A63B 7/00

[52] U.S. Cl. ..... 272/109; 272/120; 128/75; 24/129 B

[58] Field of Search ..... 272/60 R, 80, 82, 109, 272/112, 139, 137; 128/75; 182/3, 6; 244/151; 280/290

[56] References Cited

U.S. PATENT DOCUMENTS

| | | | |
|---|---|---|---|
| 1,374,697 | 4/1921 | Werndli | 272/82 |
| 2,760,774 | 8/1956 | Perez | 272/142 X |

FOREIGN PATENT DOCUMENTS

| | | | |
|---|---|---|---|
| 829,380 | 1938 | France | 128/75 |
| 279,927 | 1952 | Switzerland | 272/80 |

*Primary Examiner*—Richard C. Pinkham
*Assistant Examiner*—William R. Browne

[57] ABSTRACT

A harness securable about a user's torso is suspended from a fixed horizontal support through a system of pulleys providing a mechanical advantage in displacing the harness in the vertical direction. A pair of cords having one end anchored with respect to the pulley system and other end depending from the pulley system terminate in a pair of hand grips, respectively. Downward movement of the hand grips produces an upward movement of the harness in correspondence with the mechanical advantage provided by the selected combination of pulleys. Thereby, the user can raise himself and perform various exercises by exerting a downward force on the pair of hand grips equivalent to a fraction of one's own weight, which fraction is dependent upon the selected mechanical advantage.

3 Claims, 15 Drawing Figures

EXERCISING DEVICE FOR AERIAL EXERCISES

The present patent application is a continuation-in-part of a patent application entitled "Variable Tension Ring Exerciser", filed by the present inventor on July 16, 1973, and assigned Ser. No. 379,413, now U.S. Pat. No. 4,052,070.

The present invention relates to exercising devices and, more particularly, to exercising devices which employ a system of pulleys to provide a mechanical advantage in lifting and suspending the exercising person above ground while doing aerial exercises.

In present day society, many persons are employed in capacities which require very little physical activity. Hence, most persons have either poor muscle tone or substantially under developed muscles. Poor muscle tone or weak muscles have insufficient resiliency to prevent muscular injury or broken bones from occurring during minor spills or falls.

In an effort to combat this state of poor physical development, a substantial industry has been developed for the purpose of conditioning and/or building the physique of both males and females. In conjunction therewith, an even larger industry has been spawned which manufactures and sells various muscle building or conditioning devices. These devices generally fall into one of three categories. The first category includes such devices as bar bells, dumb bells, weight with harnesses that are attachable to various parts of the body and elements which must be compressed or stretched. The second category of devices include those which require an interplay of various muscles of the user, such as rowing machines, stationary pedalling apparatus and the type of equipment found in most gymnasiums. The third category includes those devices which are motor driven to massage, pummel and vibrate the user without requiring that the user exerts any active effort.

Regardless of which category the exercising devices may fall into, they all suffer from one basic defect — they lack the combination of fun and challenge. Therefore, the user must have a strong sense of preserverance to continue to use them day after day.

Most persons enviously admire the grace and beauty of the aerial gymnasts. However, few persons can even attempt to emulate their seemingly effortless frolicking. It is therefore a primary object of the present invention to provide apparatus which permits a person of average or even below average physical capability to perform aerial gymnastics.

Another object of the present invention is to provide exercising apparatus which tones and conditions all of the muscles of the user.

Yet another object of the present invention is to provide an exercising device which is equally easily usable by the frail and the obese.

Still another object of the present invention is to provide an exercising apparatus wherein the degree of effort required is a selectable function of the user's body weight.

A further object of the present invention is to provide an exercising device usable by those physically infirm or deformed.

A yet further object of the present invention is to provide an exercising device suitable for family use.

These and other objects of the present invention will become apparent to those skilled in the art as the description thereof proceeds.

The present invention may be described with more specificity and clarity with reference to the accompanying figures, in which.

Figure 2:
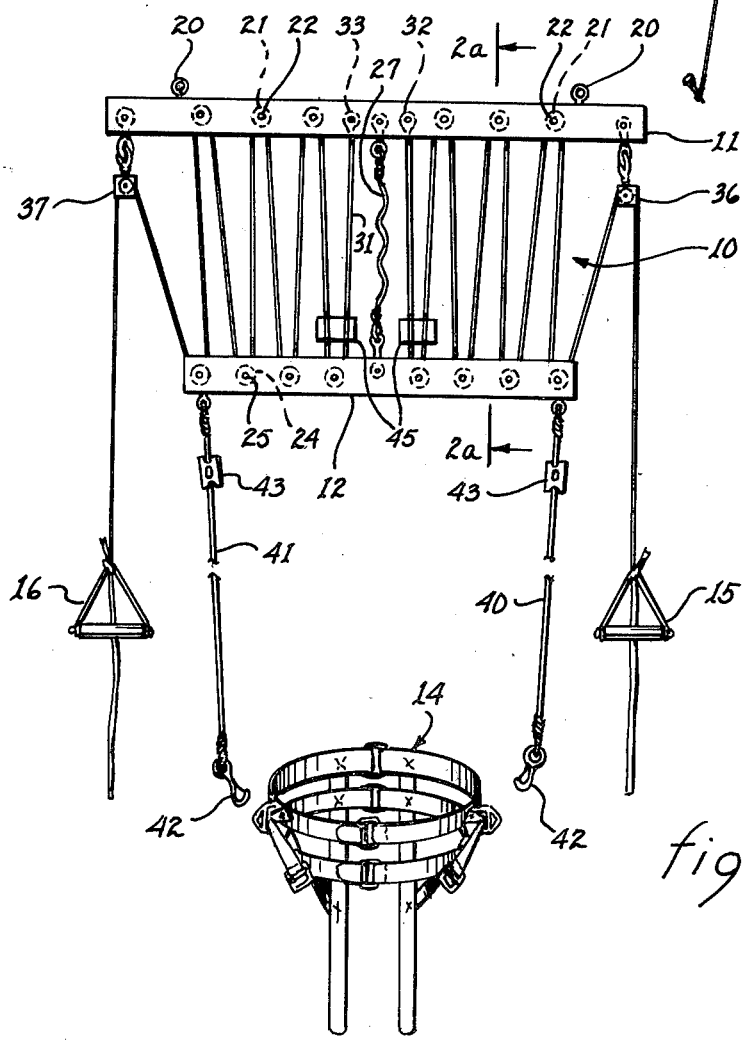
FIG. 2 illustrates a frontal view of the components of the present invention.
Figure 2A:
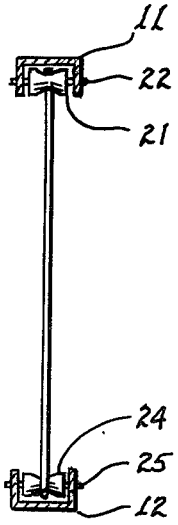

FIG. 2*a* is a cross sectional view of the pulley system employed in the present invention taken along line 2*a*, as shown in FIG. 2.

Figure 3:
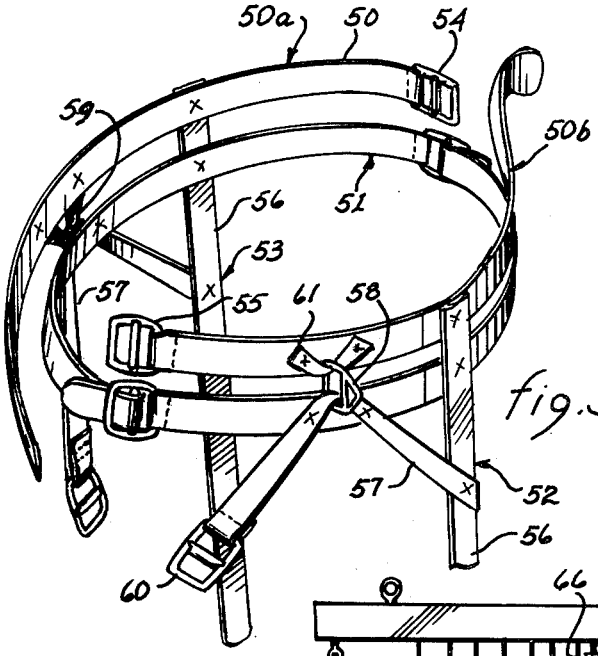

FIG. 3 illustrates the harness securable about the torso of the user.

Figure 4:
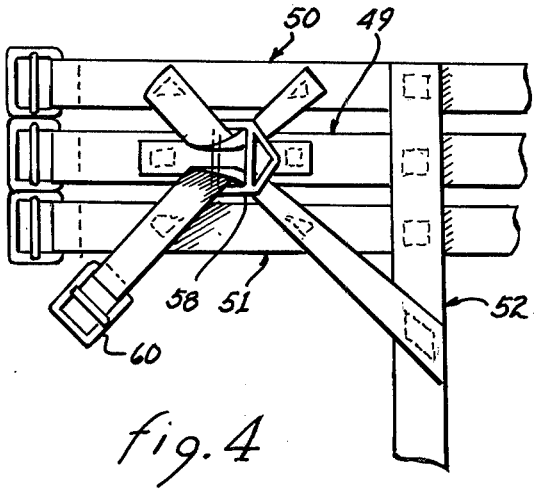

FIG. 4 illustrates a modification of the harness shown in FIG. 3.

Figure 5:
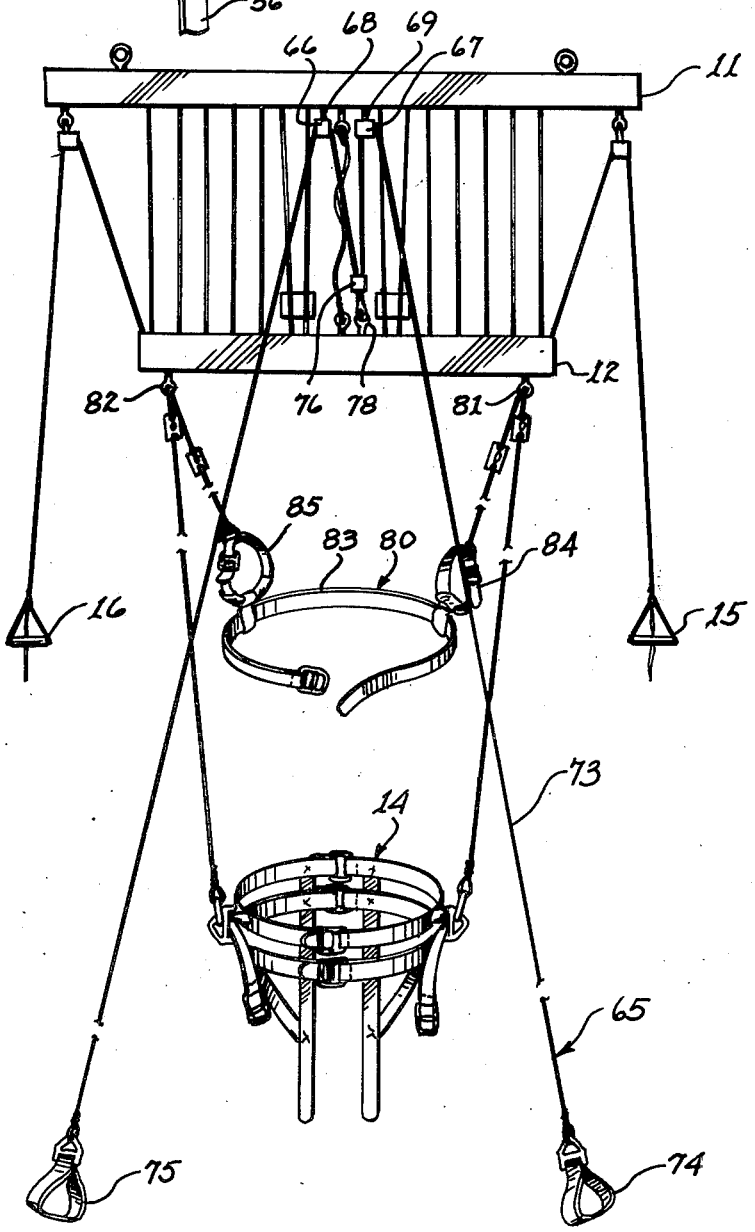

FIG. 5 illustrates further body attachment mechanism usable in conjunction with the present invention.

Figure 6:
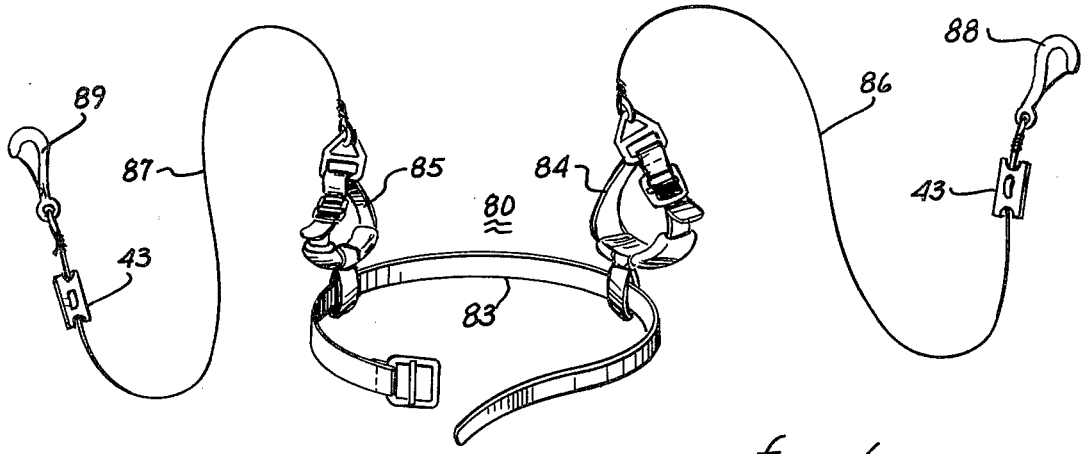

FIG. 6 illustrates an accessory harness securable about the upper chest of the user, which chest harness is usable in conjunction with the present invention.

Figure 7:
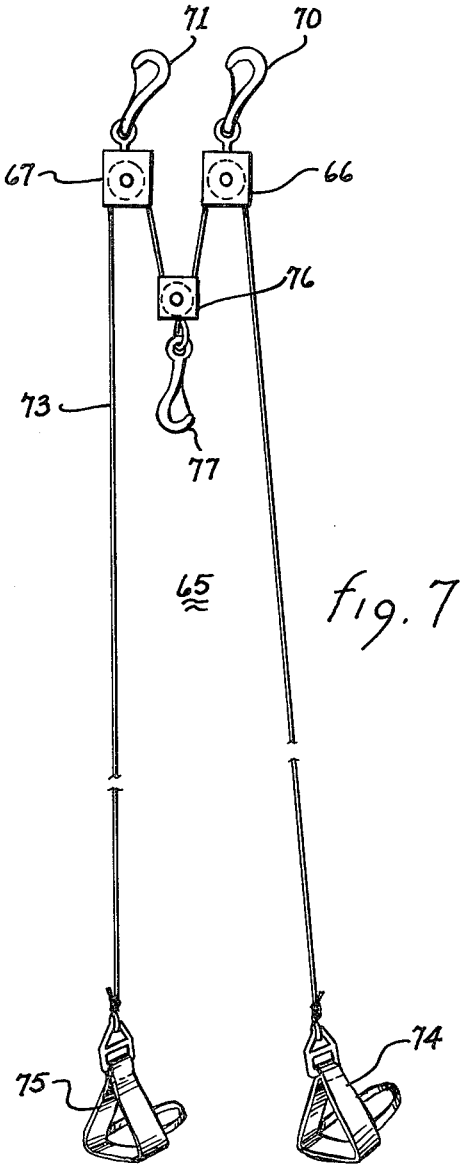

FIG. 7 illustrates an accessory foot harness usable in conjunction with the present invention.

Figure 8:
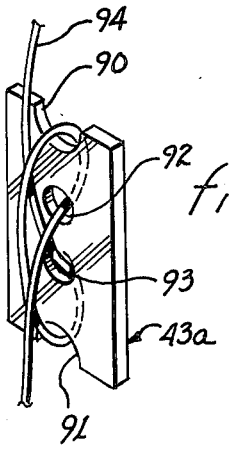

FIG. 8 illustrates a device for shortening one of the cords suspending the harness of the present invention.

Figure 9:
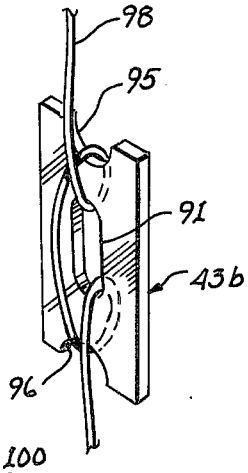

FIG. 9 illustrates a modification of the device shown in FIG. 8.

Figure 10:
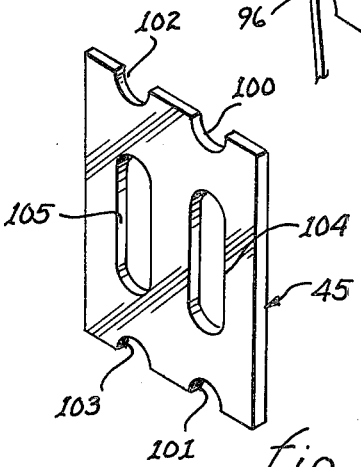

FIG. 10 illustrates a device for nonslidably joining two adjacent cords depending from a pulley.

FIGS. 11–14 illustrate various modes of the operation of the present invention.

Figure 1:
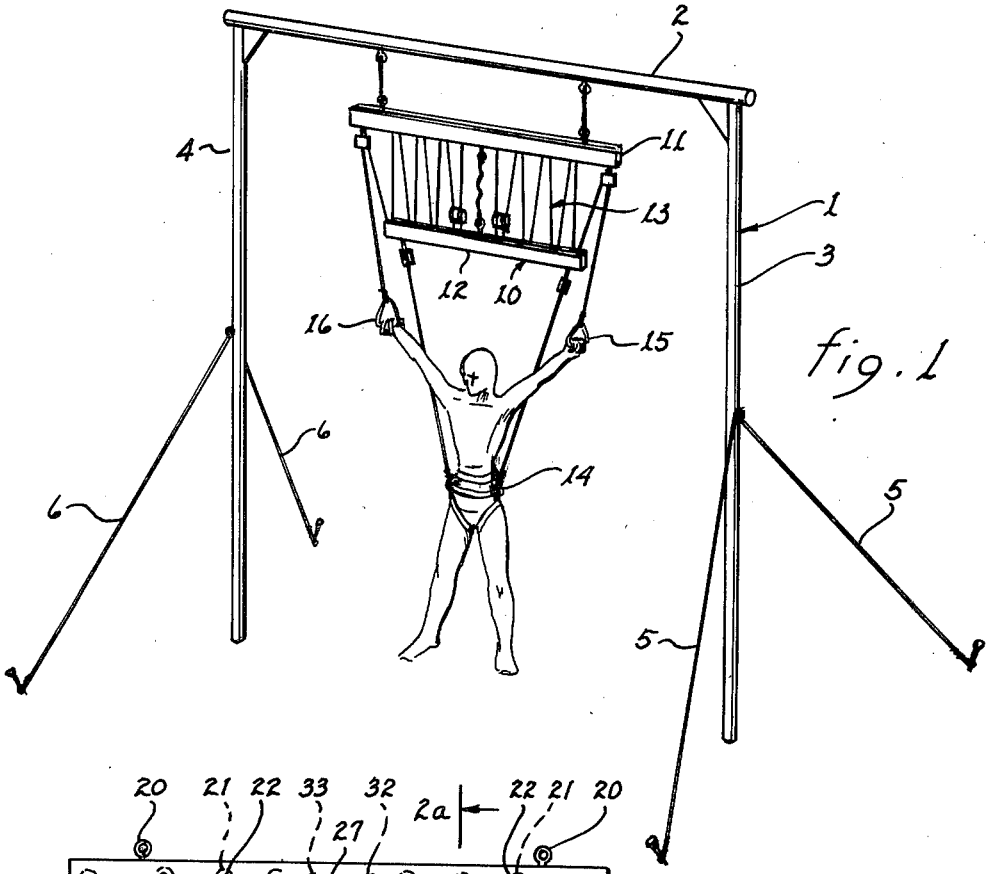
FIG. 1 illustrates a perspective view of the present invention in situ.

While the present invention may be supported from any convenient horizontal support, FIG. 1 illustrates a suitable superstructure 1. The superstructure is formed of a horizontal beam 2 secured to the upper extremity of a pair of uprights 3 and 4. Guy wires, or bracing posts, 5 and 6 may be employed to stabilize the uprights.

An exerciser 10 constructed in accordance with the teachings of the present invention depends from beam 2. The upper bar 11 of exerciser 10 may be attached to beam 2 by rigid mounting devices or by non-rigid elements such as eye bolts or chains, or combinations thereof. A vertically movable lower bar 12 is suspended from upper bar 11 by a pulley system 13. A harness 14 is attached to lower bar 12, which harness is attached to the torso of the person using exerciser 10. By inspection, it may be appreciated that any vertical movement of lower bar 12 results in a corresponding movement of harness 14. The ends of the cords forming a part of pulley system 13 terminate in a pair of hand grips 15 and 16. A downward movement of these hand grips results, due to action of the pulley system 13, in a proportional upward movement of lower bar 12, the amount of which movement is dependent upon the mechanical advantage of the pulley system. Similarly, any upward movement of hand grips 15 and 16 results in a proportional downward movement of lower bar 12.

Before a further detailed description of the present invention will be given, a brief discussion of the operation of exerciser 10 is in order. To use the present invention, a person would strap himself into harness 14. By grasping hand grips 15 and 16 and pulling downwardly thereon, a proportional upward vertical displacement of lower bar 12 will occur. The force required to pull down on hand grips 15 and 16 is a function of the person's weight divided by the mechanical advantage of pulley system 13 (less friction losses). It may therefore be appreciated that by appropriate adjustments of pulley system 13, a person can raise and lower himself with a force fully commensurate with his muscular development. Harness 14 is configured to fully support the person at his approximate center of gravity whether he be right side up, as shown, prone, supine, or upside down (see FIG. 12). Thereby, once a person has raised himself off the ground he can perform all manner of exercises normally performable only by adept gymnast. This capability provides the user with a great degree of fun and satisfaction. When the person's physical prowess increases, he can, as will be explained below, reduce the mechanical advantage provided by pulley system 13 and thereby continually increase the force required to raise and maintain himself off the ground. Thereby, the present invention is easily adaptable to a neophyte or an experienced gymnast.

Referring jointly to FIGS. 2 and 2*a*, the basic components of the present invention will be described in further detail. Upper bar 11 is formed of a length of U-shaped channel having a base and downwardly depending flanges. Connection means, such as eye bolts 20, are secured to and extend upwardly from the base of the channel for attachment to beam 2. A plurality of pulleys 21 are journalled intermediate the flanges of the channel by a plurality of shafts 22. Lower bar 12 is formed of a U-shaped channel having a base and upwardly extending flanges. A plurality of further pulleys 24 are journalled intermediate the flanges by an equivalent number of shafts 25. Upper bar 11 and lower bar 12 are connected to one another and limited in displacement from one another by means of a rope 27, or other similar flexible interconnection, firmly secured to the approximate midpoint of the upper and lower bars. Rope 27 primarily serves as a safety mechanism to limit the downward movement of lower bar 12, and hence the person strapped within the harness, should the person accidentally lose his grip on the hand grips. Rope 27 also enables to use the present exerciser in doing aerial balancing exercises without holding the pair of hand grips.

It is to be understood that one half of upper bar 11 with its pulleys engaging cord 31 and one half of lower bar 12 with its pulleys engaging cord 31 can be replaced by a block and tackle system and the other half of upper bar 11 wth its pulleys engaging cord 30 and the other half of lower bar 12 with its pulleys engaging cord 30 can be replaced by another block and tackle system without departing from the teachings of the present invention.

A pair of cords are attached to the approximate midpoint of upper bar 11 at points 32 and 33, respectively (which cords may be attached to lower bar 12 depending on the pulley arrangement). Thence, cords 30 and 31 are threaded about alternatively outwardly extending pulleys 24 and 21 to form pulley system 13. A pulley block 36 is disposed at one extremity of upper bar and another pulley block 37 is disposed at the other extremity of upper bar 11. These pulley blocks are pivotally connected to upper bar 11 to ensure a smooth operation even when hand grips 15 and 16 are moved laterally away from the plane defined by upper bar 11 and lower bar 12.

Harness 14 includes a pair of suspension lines 40 and 41, which lines are connected to respective extremities of lower bar 12. The lower extremity of each of the suspension lines includes a releasable clasp 42 to permit detachment of the harness itself. The length of suspension lines 40 and 41 must be commensurate with the height of lower bar 12 above the ground and the height of the person using the exerciser. To permit variation of the length of the suspension lines, line shortening elements 43 may be employed.

As discussed above, the mechanical advantage of pulley system 13 can be varied to increase or decrease the force necessarily applied to hand grips 15 and 16 to raise the user off the ground. The mechanical advantage of pulley system 13 may be altered by means of adjustment elements 45.

The details of the harness 14 will be described with joint reference to FIGS. 2, 3 and 4. The harness is formed of two distinct components. The first component includes a plurality of pairs of belts 50, 51 securable about the torso of the user. Each of the pairs of belts is composed of two belts (such as belts 50*a* and 50*b*) which are oriented so that the respective adapters thereof are lodged at the approximate center of the user's stomach and lower back. The second component includes a pair of seat straps 52, 53. Each of the seat straps is disposed at the approximate lateral extremity of the belt of the harness 14 and includes a first strap 56 secured to and extending transverse to pairs of belts 50 and 51. A second strap 57 is attached to strap 56 and extends upwardly therefrom. An adapter 60 is disposed at the extremity of each strap 57 for engagement with the free end of strap 56. Each of rings 58 and 59 are secured to the respective belts of pair of belts 50 by means of webbing, such as webbing 61, and to the respective belts of pair of belts 51 by means of strap 57. Thereby, rings 58 and 59 are fixedly secured at opposed lateral extremities of the belt of harness 14. The pairs of belts 50 and 51 permit adjustment of these belts to maintain the rings 58 and 59 at the lateral extremity of the belt of the harness regardless of the girth of the user.

For additional comfort, it may be advisable to employ a harness such as that shown in FIG. 4. Herein, three pairs of belts 49, 50 and 51 are employed. The additional belt 49 may be disposed intermediate belts 50 and 51; or, additional belt 49 may be disposed above belt 50 and be connected to belts 50 and 51 by one or more segments of webbing disposed laterally across the belts.

Referring jointly to FIGS. 5, 6 and 7, certain attachments useable in conjunction with the present invention will be described. To exercise muscles of the thighs, calves and ankles of the user, a foot harness 65 may be incorporated. The foot harness includes a pair of detachable pulley blocks 66, 67 suspended from eyelets 68 and 69, which eyelets depend from upper bar 11. Releasable snap hooks 70 and 71 may be disposed intermediate the pulley blocks and their respective harnesses. A further pulley block 76 and releasable snap hook 77 is secured to an eyelet 78, which eyelet extends upwardly from the approximate midpoint of lower bar 12. The approximate midpoint of a line 73 engages pulley block 76 and respective half lengths of the line extend upwardly from the pulley block to engage pulley blocks 66, 67 and depend downwardly therefrom, each terminating in a stirrup 74, 75.

A chest harness 80 may be attached to eyelets 81 and 82 depending from lower bar 12. The chest harness can be used to serve as a mechanism for maintaining the user's backbone in tension by appropriate adjustments to the relative heights of the chest harness and torso harness 14. The chest harness includes a belt 83 securable about the user's chest in proximity to his armpits. A pair of loops 84 and 85 slidably engage and extend upwardly from belt 83 to receive the upper arms of the user. Lines 86 and 87 extend upwardly from loops 84 and 85, respectively. The snap hooks engage eyelets 81 and 82 to suspend the chest harness from lower bar 12. Line shortening elements 43 may be used for adjusting the length of lines 86 and 87 to accommodate the physique of the user.

Referring jointly to FIGS. 8 and 9, there are shown two illustrations of the previously mentioned line shortening elements 43. Line shortening element 43*a* is formed of a piece of sheet metal or other relatively rigid material. The longitudinal edges of the element include aligned depressions 90 and 91. A pair of apertures 92 and 93 are disposed intermediate the depressions. In operation, a line 94 which is to be shortened is threaded through apertures 92 and 93 and then loop of the line between apertures 92 and 93 is wrapped about depressions 91 and 90. The degree of shortening of line 94 may be varied depending upon the number of times the line is wrapped around depressions 90 and 91.

Referring to FIG. 9, element 43*b* is also formed of a piece of sheet metal or other relatively rigid material. A pair of depressions 95 and 96 is disposed at opposite longitudinal edges thereof. An elongated central aperture 97 is disposed intermediate depressions 95 and 96. In operation, a loop of a line 98 to be shortened is inserted through aperture 97 and thence wrapped around depressions 95 and 96. Again, the degree of shortening may be varied depending upon the number of times the loop is wrapped around the depressions.

Referring to FIG. 10, there is shown a line adjustment element 45 which can be used to vary the mechanical advantage of the pulley system 13 (see FIG. 1). Element 45 is formed of a piece of sheet metal or other relatively rigid material. Aligned pairs of depressions 100, 101 and 102, 103 are disposed at opposite longitudinal edges of the element. An elongated aperture 104 is disposed intermediate depressions 100 and 101 and a further aperture 105 is disposed intermediate depressions 102 and 103. In operation, a loop of each of two adjacent cords extending from any one of the pulleys of the pulley system 13 is inserted through one of apertures 104 and 105 and wrapped about element 45 in the manner shown in FIG. 9. Thereby, independent movement between the two adjacent cords is inhibited. Thus, any one of the pulleys 21 or 24 effectively becomes the anchor point for one of cords 30 and 31, respectively, whereby the mechanical advantage of the pulley system can be selectively varied. In the alternative, the ends of cords 30 and 31 can be detached from anchor points 32 and 33 and reattached to one of the pulleys to vary the mechanical advantage. In the preferred embodiment, the width of the depressions is slightly less than the diameter of the cord so that cords are wedged in the depressions and restrained from unwrapping.

Figure 11:
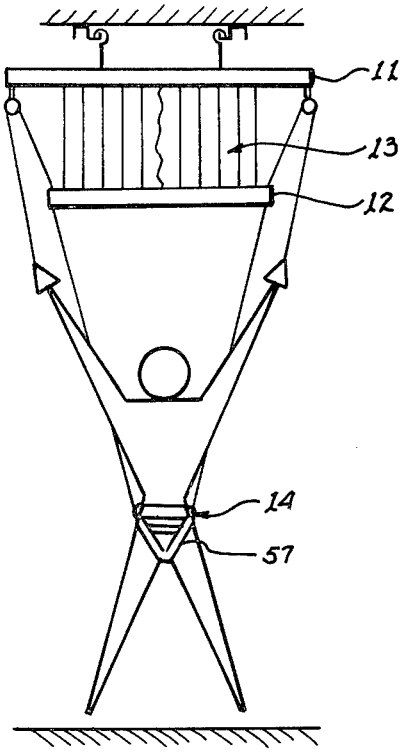
Figure 12:
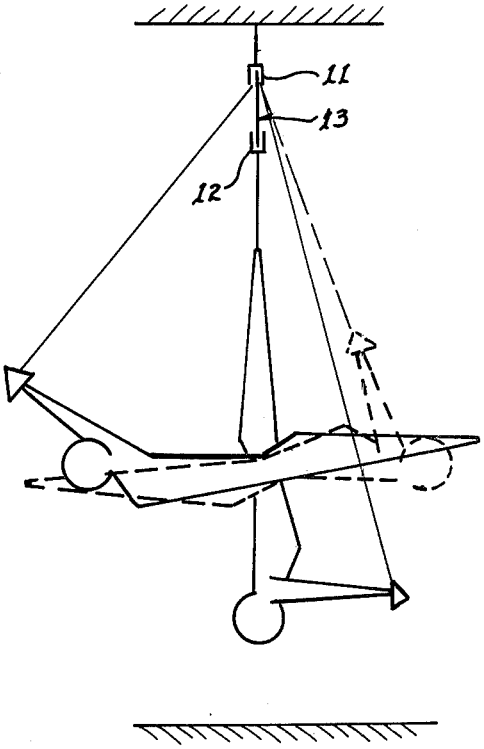
Figure 13:
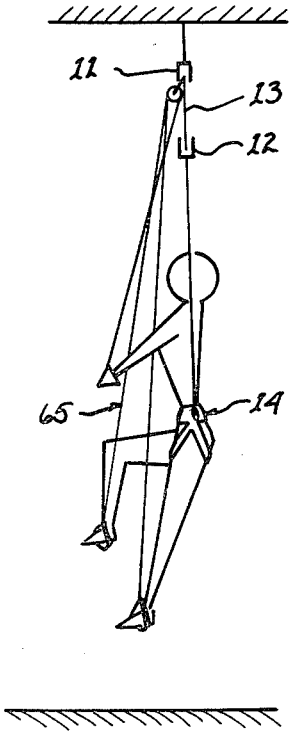
Figure 14:
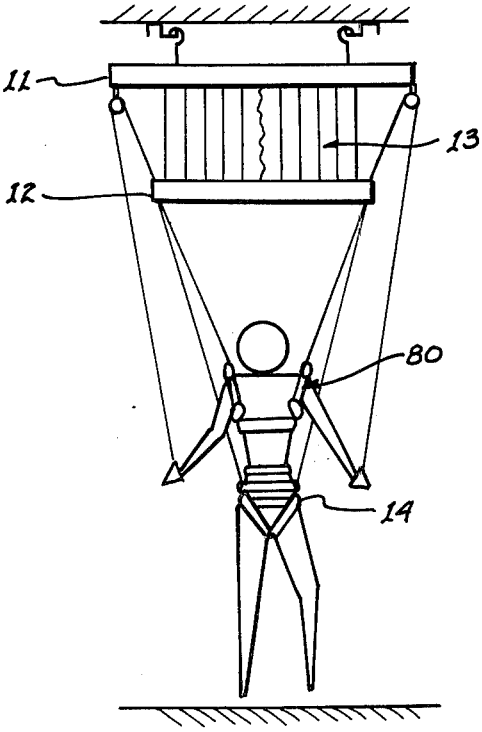

FIG. 11 illustrates a user strapped into harness 14 in the upright position after lifting oneself off the ground. It may be noted that harness 14 is secured just above the user's hip with pair of straps 57 being wrapped around the user's thighs. FIG. 12 illustrates certain ones of various positions into which the user can place oneself. Not only the user can balance oneself in vertical or horizontal positions, but one can place oneself in any orientation in the air. In each of these positions or modification thereof, a variety of exercises can be performed, which variety is only limited by the user's imagination. FIG. 13 illustrates the user using the foot harness in combination with the torso harness. It may be noted that downward movement of one stirrup is countered by the upward movement of of lower bar 12 or by the upward movement of the other stirrup. It should be understood that the kicking, splitting and stepping movements of legs in various positions shown in FIG. 12 provide more than plenty of leg exercising. The foot harness shown in FIG. 13 may be used for therapeutic purpose. FIG. 14 illustrates the user with the chest harness strapped about one's shoulders. By appropriate adjustments to the lines suspending the chest harness from lower bar 12 relative to the lines suspending the torso harness, the stress on the user's back can be controlled from any tension to any compression. The chest harness may be used to prevent the user from tumbling and imposing unwanted stress on one's back in therapeutic application.

While the principles of the invention have now been made clear in an illustrative embodiment, there will be immediately obvious to those skilled in the art many modifications of structure, arrangement proportions, elements, materials and components, used in the practice of the invention which are particularly adapted for specific environments and operating requirements without departing from those principles.

I claim:

1. A personal exercising apparatus depending from a fixed horizontal support for performing aerial exercises above ground; said exercising apparatus comprising in combination:

a. a harness suspended from said horizontal support by a pair of cords, said harness being adapted for encircling a user's lower torso;

b. a system of pulleys interconnecting said horizontal support and said pair of cords suspending said harness, said pulley system providing a mechanical advantage in vertically displacing said harness with respect to said horizontal support, and said pulley system including a pair of cords, one end of each of said pair of cords being anchored with respect to said pulley system and the other end of each of said pair of cords depending from said pulley system; and c. a pair of hand grips adapted for grasping by the user, each of said pair of hand grips attached to each of said pair of cords depending from said pulley system; whereby, the mechanical advantage provided by said pulley system permits the user to raise and maintain oneself off the ground with a downward force applied to said pair of hand grips, which downward force is substantially less than the weight of the user;

wherein said harness comprises:

a belt for encircling the user's torso, said belt including means for adjusting the lengths of the front half and the rear half of said belt;

a pair of rings for securing said pair of cords suspending said harness, each of said pair of rings attached to diametrically opposed sides of said belt;

a first strap having bifurcated root for encircling one thigh of the user, first root of said first strap attached to the rear half of said belt, and an intermediate section of second root of said first strap inserted through one of said pair of rings and secured to said belt, end of said second root of said first strap depending from said belt including an adapter for selectably securing the free end of said first strap; and a second strap having bifurcated root for encircling the other thigh of the user, first root of said second strap attached to the rear half of said belt, and an intermediate section of second root of said second strap inserted through another of said pair of rings and secured to said belt, end of said second root of said second strap depending from said belt including an adapter for selectably securing the free end of said second strap; whereby, said first and second straps prevent said harness from sliding about the user's torso.

2. The apparatus as set forth in claim 1 wherein said belt of said harness comprises;

a. a first pair of belts attached to one another by means of adapters;

b. a second pair of belts attached to one another by means of adapters; whereby, said harness is adjustable to maintain the diametrically opposed positions of said pair of rings regardless of the girth of the user's torso; and c. each of said pair of rings secured to each of said first pair of belts by a section of webbing inserted through said ring and secured to each of said first pair of belts, each of said pair of rings further secured to each of said second pair of belts by an intermediate section of each of said pair of second roots of said straps inserted through said ring and secured to each of said second pair of belts.

3. The apparatus as set forth in claim 2 including a third pair of belts secured parallel to said first and second pair of belts.

* * * * *